US011565373B2

(12) United States Patent
Ashworth

(10) Patent No.: US 11,565,373 B2
(45) Date of Patent: Jan. 31, 2023

(54) WET BLASTING MACHINES

(71) Applicant: Vapormatt Ltd, Vale (GG)

(72) Inventor: Terence Ives Ashworth, Vale (GG)

(73) Assignee: VAPORMATT LTD, Vale (GG)

( * ) Notice: Subject to any disclaimer, the term of this patent is extended or adjusted under 35 U.S.C. 154(b) by 0 days.

(21) Appl. No.: 15/891,582

(22) Filed: Feb. 8, 2018

(65) Prior Publication Data

US 2018/0222016 A1 Aug. 9, 2018

(30) Foreign Application Priority Data

Feb. 8, 2017 (GB) ..... 1702085

(51) Int. Cl.

| | |
|---|---|
| ***B24C 3/08*** | (2006.01) |
| ***B24C 5/04*** | (2006.01) |
| ***B24C 3/04*** | (2006.01) |
| ***B24C 3/12*** | (2006.01) |
| ***B24C 5/02*** | (2006.01) |
| ***B24C 3/32*** | (2006.01) |
| ***B21C 43/04*** | (2006.01) |
| ***B24C 3/02*** | (2006.01) |
| ***B24C 7/00*** | (2006.01) |
| *B24C 1/08* | (2006.01) |

(52) U.S. Cl.

CPC ..... *B24C 5/04* (2013.01); *B21C 43/04* (2013.01); *B24C 3/02* (2013.01); *B24C 3/08* (2013.01); *B24C 3/081* (2013.01); *B24C 3/12* (2013.01); *B24C 3/32* (2013.01); *B24C 5/02* (2013.01); *B24C 7/0007* (2013.01); *B24C 1/086* (2013.01)

(58) Field of Classification Search

CPC ..... B24C 1/08; B24C 1/083; B24C 1/086; B24C 3/02; B24C 3/08; B24C 3/082; B24C 3/12; B24C 3/18; B24C 3/32; B24C 5/02; B24C 5/04; B24C 7/0007; B24C 43/04

USPC ..... 451/38, 90, 102

See application file for complete search history.

(56) References Cited

U.S. PATENT DOCUMENTS

| | | | | |
|---|---|---|---|---|
| 1,889,132 A | | 11/1932 | Peik | |
| 4,394,786 A | * | 7/1983 | Stalson | B08B 5/023 134/21 |
| 4,417,118 A | * | 11/1983 | Miyano | B23H 7/102 219/69.12 |
| 5,041,710 A | * | 8/1991 | Hamal | B23K 9/013 219/70 |
| 5,277,048 A | * | 1/1994 | Lubas | B21C 9/00 72/319 |

(Continued)

FOREIGN PATENT DOCUMENTS

| | | |
|---|---|---|
| BE | 1 011 508 A6 | 10/1999 |
| CN | 203993567 U | 12/2014 |

(Continued)

*Primary Examiner* — Eileen P Morgan

(74) *Attorney, Agent, or Firm* — BakerHostetler

(57) ABSTRACT

A wet blast machine for cleaning or preparing surfaces comprises: a treatment source for providing a pressurised mixture of treatment material; a nozzle, the nozzle comprising: an inlet for receiving the pressurised mixture of treatment material; an outlet for ejecting the pressurised mixture; and at least one hole in a wall of the nozzle, the hole for feeding one or more products into the nozzle such that one or more surfaces of the product are exposed to the treatment material whilst within the nozzle, allowing for a more efficient wet blast of the products.

8 Claims, 10 Drawing Sheets

(56) References Cited

U.S. PATENT DOCUMENTS

| | | | | |
|---|---|---|---|---|
| 5,312,530 | A * | 5/1994 | Lindwall | B05B 13/0207 204/206 |
| 5,613,286 | A * | 3/1997 | McCabe | B21C 43/04 15/308 |
| 5,904,610 | A | 5/1999 | Ciniglio et al. | |
| 6,698,639 | B1 * | 3/2004 | Otomo | B23H 7/102 226/97.4 |
| 9,168,634 | B1 * | 10/2015 | Kelson | B24C 3/081 |
| 9,475,173 | B1 * | 10/2016 | Kelson | B24C 3/081 |
| 2003/0010753 | A1 * | 1/2003 | Yamada | B23H 7/102 219/69.12 |
| 2005/0076689 | A1 * | 4/2005 | Liu | B21F 99/00 72/53 |
| 2009/0236318 | A1 * | 9/2009 | Sakaguchi | B23H 7/105 219/69.12 |
| 2011/0233172 | A1 * | 9/2011 | Sato | B23H 7/105 219/69.15 |
| 2013/0143473 | A1 | 6/2013 | Hibino et al. | |
| 2014/0366802 | A1 * | 12/2014 | Itoh | C23C 2/40 118/712 |
| 2018/0043408 | A1 * | 2/2018 | Nakano | B24C 1/086 |

FOREIGN PATENT DOCUMENTS

| | | | | |
|---|---|---|---|---|
| DE | 42 44 234 | A1 | 6/1994 | |
| DE | 199 54 988 | A1 | 5/2001 | |
| GB | 1234680 | A * | 6/1971 | B24C 3/12 |
| GB | 1247701 | A * | 9/1971 | B24C 3/12 |
| GB | 2 065 514 | A | 7/1981 | |
| GB | 2 175 976 | A | 12/1986 | |
| JP | 9-300220 | A | 11/1997 | |

* cited by examiner

WET BLASTING MACHINES

CROSS-REFERENCE TO RELATED APPLICATIONS

This application claims priority to foreign Great Britain patent application No. GB 1702085.0, filed on Feb. 8, 2017, the disclosure of which is incorporated by reference in its entirety.

FIELD OF THE INVENTION

According to an aspect of the present disclosure, there is provided a wet blast machine. In particular, there is provided a wet blast machine comprising a nozzle; a blast gun comprising said nozzle; and a method of treating a product using said nozzle.

BACKGROUND

In the wire manufacturing industry, after drawing of a wire, the wire often needs cleaning or treated to be rendered suitable for the intended application. For example, for cleaning, this is traditionally done by acid baths, however, environmental considerations have put pressure on companies to find alternative methods.

One such technique is to apply a vapour blast (also known as a wet blast) of treatment material using a pressurised treatment material passed through the nozzle of a blast gun. The wire or other material to be treated is fed past the exit treatment or blast stream of pressurised treatment material exiting the nozzle to treat or clean the wire as it passes.

However, blasting small diameter wires is expensive as the vapour blast stream needs to be quite large to allow for the wire vibrating in the blast stream. Whilst it is possible to add guides near the blast stream, these have a tendency to wear out quickly and also add to the complexity of the machine required to feed the wire past the treatment or blast stream.

Additionally, this technique is quite inefficient as the volume of treatment material and cone width of the blast stream is nowhere near spent after just hitting a single small diameter wire.

SUMMARY OF THE INVENTION

According to a first aspect of the present disclosure there is provided a wet blast machine for cleaning or preparing surfaces, said machine comprising: a treatment source for providing a pressurised mixture of treatment material; a nozzle, said nozzle comprising: an inlet for receiving the pressurised mixture of treatment material; an outlet for ejecting said pressurised mixture; and at least one hole in a wall of the nozzle, said hole for feeding one or more products into the nozzle such that one or more surfaces of the products are exposed to the treatment material whilst within the nozzle.

Exposing the products to the treatment material whilst within the nozzle supports the products in the blast stream of pressurised mixture. This reduces vibration of the products within the blast stream and allows a smaller or lower volume of blast stream to be used (because the width of the blast stream does not need to account for vibrating products requiring a larger blast cone). This, in turn, eliminates the need for guides placed external to the nozzle to support the products that are sometimes used—as can be appreciated, such guides wear out and add to the complexity of the wet blast machine.

The product to be treated may be a continuous product, for example an elongate member such as a wire or a flat sheet, or it may be a specific part or series of parts capable of being fed into the nozzle.

The nozzle may comprise one or more narrow walled sections, each section providing an enlarged internal diameter for the nozzle. The narrowed sections may substantially coincide with the location of the one or more holes. The narrowed sections may allow treatment material to pass around and treat the multiple surfaces of the products. This may allow for a more effective and more efficient treatment of the products.

Where multiple holes are provided, several products can be treated simultaneously with the same treatment material—this reduces wastage and increases the efficiency of the wet blast machine.

The treatment source may comprise a treatment pipe for providing the treatment material to the nozzle, the treatment pipe comprising a treatment bore, wherein the nozzle extends from the treatment pipe such that the inlet of the nozzle is in fluid communication with the treatment bore. In some examples, a central axis of the nozzle is substantially perpendicular to a central axis of the treatment bore, for example the central axis of the nozzle may be at an angle of between 80 degrees and 100 degrees relative to the central axis and direction of treatment material flow of the treatment bore. In other examples, the central axis of the nozzle may be at an oblique angle relative to the central axis of the treatment bore and direction of treatment material flow, such angle may be approximately 30, 40, 45, 50, 60, or 70 degrees, with the bore of the nozzle from the entry to the exit aligned with the direction of treatment flow.

In a similar manner to the first aspect, in this embodiment the efficiency of the wet blast machine is improved by the use of a treatment pipe that feeds or provides the treatment material to the nozzle. Additionally, multiple nozzles can be fed by the treatment pipe, each nozzle as defined above.

The pressure and flow velocity of treatment material within the treatment pipe may typically be at a lower rate than within the nozzle. A high flow velocity within the nozzle may ensure no blockages occur within the nozzle.

The machine may further comprise a pressurised air inlet extending from the treatment pipe, the air inlet comprising an air bore, wherein the air bore is in fluid communication with the treatment bore and the inlet of the nozzle for diverting a portion of the treatment material into the nozzle through the inlet.

In such examples, treatment material may be forced into the nozzle when pressurised air is injected through the pressurised air inlet. This arrangement may limit the amount of treatment material entering the nozzle, reducing the risk of the treatment material causing blockages in the bore of the nozzle. This is particularly advantageous when the internal diameter or bore of the nozzle is relatively narrow or small, for example having a diameter of only 2 to 5 mm. Additionally, the pressure to divert the pressurised treatment material from the treatment pipe into the nozzle is provided by the pressurised air, so the treatment material in the nozzle may have a higher or a lower pressure than the pressure of the treatment material within the treatment pipe.

The use of pressurized air to divert treatment material from the treatment pipe and into the nozzles allows a lower flow velocity of treatment material to be used within the treatment pipe, whilst also providing a higher flow velocity of treatment material through the nozzle. As noted above, a high flow velocity of treatment material within the small bore nozzle prevents blockages and allows for efficient and fast blast cleaning of products including elongate materials, such as wires that pass through the one or more holes in the nozzle. The lower flow velocity but higher flow rate within the treatment pipe may reduce frictional losses and damage by abrasion and allow the treatment material to be constantly moving. This both ensures that the treatment material is prevented from solidifying, and can ensure that there is no lag in supply of treatment material to any of the nozzles (there is no need to wait for the flow of treatment material to reach the nozzle).

Furthermore, this arrangement removes the conventional mixing chamber used in previous wet blast machine systems. This allows the nozzle and/or blast gun construction to be potentially simplified, whilst also allowing for a single treatment pipe feeding multiple nozzles.

The treatment pipe may comprise a mechanism to prevent the treatment material from causing blockages in the treatment pipe. For example an outlet of the treatment pipe may be open ended and/or comprise a bypass mechanism to divert the treatment material away from the treatment pipe. The treatment pipe outlet may have an adjustable valve allowing the flow rate and pressure of the treatment material in the pipe to be controlled. This arrangement ensures sufficient flow rate in the treatment pipe to prevent blockages.

The use of such a treatment pipe allows a series of nozzles to be supplied treatment material by a single supply of treatment material. As described above, the treatment material may be continually flowing within the treatment pipe, with nozzles activated as desired by actuation of the compressed air inlet valve for any given nozzle, using compressed air to divert treatment material into said nozzle.

In some examples, a central axis of the air bore may be substantially perpendicular to the central axis of the treatment bore. For example the central axis of the air bore may be at an angle of between 80 degrees and 100 degrees relative to the central axis of the treatment bore.

The air bore may be substantially aligned with the central axis of the nozzle. For example, the central axis of the air bore may be axially aligned with the nozzle.

In some examples, the diameter of the treatment bore may be larger than the internal diameter of the nozzle.

In some examples, the machine may comprise additional nozzles. In such examples, the machine may comprising a first air inlet extending from the treatment pipe and a second air inlet extending from the treatment pipe, the first air inlet comprising an air bore in fluid communication with the treatment bore and the nozzle, and the second air inlet comprising an air bore in fluid communication with the treatment bore and an additional nozzle.

In such examples, multiple products may be treated simultaneously by the plurality of nozzles. Each nozzle may have an associated pressurised air inlet. When air is injected through an air inlet, treatment material is forced from the treatment bore into the nozzle associated with that air inlet. Each air inlet may be operated independently of any other air inlets.

Additionally, the use of additional air inlets and pressurized air to divert and cause treatment material to flow within a plurality of nozzles allows for a greater control of which nozzles are active, and the rate of blasting of the surfaces of the products. Unused nozzles may be automatically shut down when the flow of pressurized air is cut off by a regulator or other suitable device.

The products may typically be elongate members, for example a wire, a band saw blade, or a carding wire. However, for brevity, where wire has been used in the following description, this may also be taken to be a reference to a general product.

In embodiments, said holes may be provided substantially perpendicular to walls of the nozzle. For example, the holes may be aligned along an axis that intersects the central axis of the nozzle, or they may be aligned along an axis that does not intersect with the central axis of the nozzle.

Additionally or alternatively, said plurality of holes may be provided at an angle relative to walls of the nozzle, said angle being preferably approximately 45 degrees, for example the angle may be between 40 degrees and 50 degrees, or alternatively between 60 and 120 degrees. Such angles typically provide the highest removal rate. As well as increasing the exposure, the blast effect by the treatment material is most powerful at such angles. Providing the holes at an angle relative to the walls increases the exposure of surfaces of products passing through the holes to the treatment material by increasing the relative time spent within the nozzle and in contact with the treatment material relative to holes aligned perpendicular to the bore. In other words, the products are fed into the nozzle at an angle. The blast effect may also be most powerful at angles of approximately 45 degrees—i.e. the material removal rate may be maximised at such angles.

In some examples, the one or more holes may comprise a plurality of holes for processing of multiple products simultaneously by said treatment material. In other embodiments, the holes may guide the products transverse to the bore defining wall.

By providing multiple holes for receiving multiple wires, more of the treatment material is utilised at one time as the blast stream of pressurised treatment material generated and passing through the nozzle impinges on all of the exposed surfaces.

Additionally, utilising the holes to align the angle at which the products are exposed to the treatment material may eliminate the need for guides provided within the blast stream of pressurised treatment material. The operating lifespan of the wet blast machine is subsequently solely dependent on the lifespan of the nozzle alone, rather than both the nozzle and a separate guide means, reducing downtime of the machine.

In some embodiments, said holes may comprise one or more entry holes for entry by an untreated wire or product to the nozzle and one or more exit holes for exit of said wire or product after treatment by the treatment material. Each entry hole may be directly aligned with its corresponding exit hole. This provides easier alignment of the wire as it passes from the entry hole to the exit hole. Alternatively, or additionally, the entry and exit holes may be aligned at different angles, such that the central axis of each hole does not align. This can provide a small degree of twist to the wire, altering the surface of the wire exposed to the incident pressurised treatment material as the wire passes through the nozzle.

The inlet may comprise a convergent entry portion. The convergent entry portion may be frustoconical in shape and act to direct the pressurised flow of treatment gas through the nozzle.

In embodiments a bore can run substantially parallel through the nozzle. This acts to accelerate the flow of the pressurised treatment gas through the nozzle after entry from the convergent entry portion. Depending on the relative size of the bore, the Venturi effect created can be tailored.

The bore typically runs substantially centrally through the nozzle. This maximises the flow of the pressurised treatment gas and minimises losses due to frictional forces from the walls of the bore. A cross-section of the bore may be substantially circular, or may be of any other shape, for example square or rectangular.

The one or more holes can comprise a plurality of holes for processing of multiple wires simultaneously by said treatment material. This utilises the pressurised flow of treatment material more efficiently than using a single wire in the nozzle.

The treatment material is typically a slurry of abrasive material and fluid. This acts to reduce dust and provide a controlled blasting of surfaces.

The nozzle may comprise an external shape to fit within a vapour blast gun. Such nozzles are typically replaceable components within larger vapour blast equipment. Such external shape may facilitate push fit connection with such vapour blast material such as vapour blast guns.

The machine may further comprise a second blast gun having features as described with respect to the blast gun described above wherein a product passes through the nozzles of the blast gun and second blast gun.

According to a second aspect of the disclosure there is provided a system for treating products, said system comprising a plurality of wet blast machines according to any embodiment of the first aspect. The provision of such a system allows for increased productivity of the system and products from a first wet blast machine may then be fed into a second wet blast machine. Alternatively, or additionally, where present, a common treatment pipe may supply treatment material to each wet blast machine.

According to a third aspect of the present disclosure there is provided a method of cleaning and preparing surfaces of a product, said method comprising the steps of: supplying a flow of pressurised treatment material to an inlet of a nozzle; and feeding one or more products to be treated through a plurality of holes in the nozzle, exposing the surfaces of the products to the pressurised treatment material whilst within the nozzle. It can be appreciated that the associated advantages of the first aspect may be relevant to the third aspect.

In embodiments, the pressurised treatment material may be spun through the nozzle. This may be achieved by applying a vortex to the pressurised treatment material. Applying angular momentum to the treatment material may provide for treatment of sides of wire being treated, rather than just the face presented to the incident flow of treatment material.

In embodiments, the one or more products can be passed through the plurality of holes in the nozzle at an approximately 45 degree angle, for example an angle between 40 degrees and 50 degrees, or of 60 to 120 degrees, to the flow of pressurised treatment material. This provides similar advantages as described in the first aspect.

In some examples, supplying a flow of pressurised treatment material to the inlet of the nozzle may comprise: attaching the nozzle to a treatment pipe such that the nozzle extends from the treatment pipe; passing a treatment material through the treatment pipe; and forcing treatment material into the nozzle using pressurised air injected into the treatment pipe by a pressurised air inlet.

According to a fourth aspect of the present disclosure, there is provided a blast gun for discharging a mixture of treatment material and gas, said blast gun comprising a body having an internal mixing chamber of elongated form, duct means for introducing separate flows of the treatment material and gas into a common end of the mixing chamber, and a nozzle demountably disposed within said mixing chamber and wherein said nozzle comprises an inlet for receiving the pressurised mixture of treatment material; an outlet for ejecting said pressurised mixture; wherein a wall of the nozzle comprises at least one hole, each hole for feeding products through the nozzle such that surfaces of the products are exposed to the treatment material whilst within the nozzle.

Again, it can be appreciated that the associated advantages of any preceding aspect may be applied to the fourth aspect—in particular, the advantages associated with exposing the products whilst within the nozzle and the potential use of a treatment pipe to supply the treatment material.

The nozzle may further comprise the features of any of the nozzles described in any other embodiment of any other aspect of the disclosure.

The blast gun may further comprise a treatment pipe between the mixing chamber and the nozzle, wherein the nozzle is mounted substantially perpendicular to the treatment pipe.

The blast gun may further comprise a pressurised air inlet for injecting compressed air into the treatment pipe to force the mixture into the nozzle.

According to an aspect of the present disclosure there is provided a nozzle for a blast gun or micro blast gun, said nozzle comprising: an inlet for receiving a pressurised mixture of treatment material from a blast gun; an outlet for ejecting said treatment material; and a bore defining wall running through the nozzle from the inlet to the outlet, wherein wall comprises a plurality of holes for guiding one or more products through the bore such that the wires are exposed to the treatment material within the bore.

The nozzle may further comprise any feature of any nozzle described in relation to any aspect of the present disclosure.

According to another aspect of the present disclosure there is provided a blast gun or micro blast gun for providing a pressurised mixture of treatment material, the blast gun comprising: a treatment pipe comprising a treatment bore, and a nozzle attachment means for attaching a nozzle to the treatment pipe; and a pressurised air inlet extending from the treatment pipe, the air inlet comprising an air bore, wherein the air bore is in fluid communication with the treatment bore and the nozzle attachment means.

The air inlet may be configured to fire compressed air into the nozzle. This diverts treatment material from the pipe into the nozzle. The flow velocity of the treatment material within the nozzle can be greater than the flow velocity of the pressurized material within the treatment pipe. This has the advantages described above. It can be appreciated that the air inlet can be configured to fire compressed air blasts at the correct rate for the desired blasting process and rate. This allows greater tailoring of the blast process when compared to regulating the flow velocity using either a nozzles having different diameters from a single source of pressurized treatment material or from a single nozzle with a single source of pressurized treatment material.

The treatment pipe and air inlet may further comprise any feature described in relation to the treatment pipe and air inlet or inlets of the first aspect. In particular a central axis of the nozzle may be substantially perpendicular to a central axis of the treatment bore. A central axis of the air bore may be substantially perpendicular to the central axis of the treatment bore. The central axis of the air bore may be axially aligned with the central axis of the nozzle. The diameter of the treatment bore may be larger than the diameter of the nozzle. The flow velocity of treatment material through the nozzle may be greater than the flow velocity of treatment material through the treatment pipe.

In some embodiments the air inlet may be a first air inlet, and the blast gun may further comprise a second air inlet extending from the treatment pipe and an additional attachment means for attaching an additional nozzle to the treatment pipe, the second air inlet comprising an air bore in fluid communication with the treatment bore and the additional nozzle.

The nozzle may have a non-uniform internal diameter. The internal diameter may be convergent from the inlet to the outlet.

According to another aspect of the present disclosure there is provided an apparatus for treating wire, said apparatus comprising: means for providing a pressurised treatment material for treating wire; a nozzle as described in any preceding aspect; and means for providing wire through said holes in said nozzle to allow treatment of the wire by said treatment material.

Such means for providing the pressurised treatment material may be a vapour blast gun with ducts, hoses and other suitable components for providing pressurised treatment material. Such means for providing wire may include a wire spooling mechanism.

In some embodiments according to this aspect, the nozzle is a first nozzle, and the apparatus further comprises a second nozzle, wherein at least one pair of the plurality of holes of the first nozzle is aligned with a pair of the plurality of holes of the second nozzle.

It can be appreciated that, although certain examples and embodiments described above have been primarily described with respect to a single aspect, the features described are also applicable to the other aspects defined herein.

These and other aspects of the invention will be apparent from, and elucidated with reference to, the embodiments described hereinafter.

BRIEF DESCRIPTION OF THE DRAWINGS

Embodiments will be described, by way of example only, with reference to the drawings, in which.

DETAILED DESCRIPTION

Figure 1:
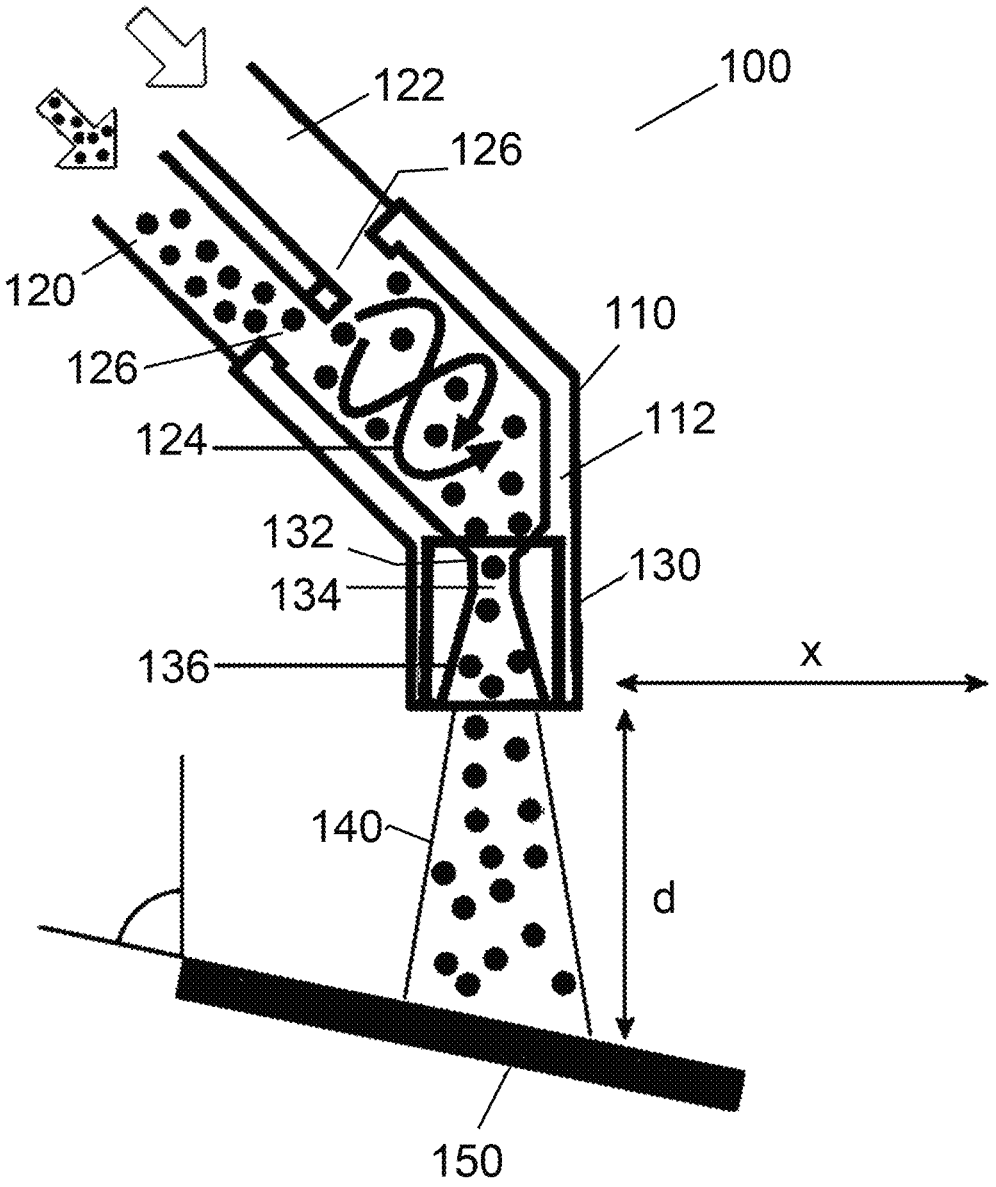
FIG. 1 illustrates a prior art vapour blast device.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments.

DETAILED DESCRIPTION

FIG. 1 shows a vapour blast device 100, such as a vapour blast gun for ejecting a pressurised mixture of treatment material (typically abrasive material) and a gas such as air. A typical device 100 is described in detail in GB2065514A. Briefly, however, the device 100 generally comprises a body 110 into which a treatment material such as a slurry (typically comprising an abrasive and water) 120 and a pressurised gas, such as compressed air, 122 are provided and mixed in a mixing chamber 124 to form a pressurised slurry 112. Ducts 126 provide the material 120 and the gas 122 into the mixing chamber. The ducts may enact a rotational angular momentum to the material and gas to create a vortex spun slurry. The mixing chamber is generally formed of one piece moulding from tough material such as metal or high grade plastic. Disposed within the body is a nozzle 130. In the conventional blast device 100, shown in FIGS. 1 and 2, such nozzle acts to direct the pressurised slurry 112 from an inlet 132 of the nozzle towards an outlet 136 via a central passageway or bore 134. The bore 134 may be narrower than the inlet 132 and outlet 136. The narrower bore 134 and expansion of the pressurised gas combine to increase the velocity of the pressurised slurry 112.

The slurry 112 is then directed in a coned outlet or blast stream 140 towards a wire 150 or other surface to be treated. In the example shown, the distance d between the wire 150 and the outlet 136 can be controlled, together with the relative angle between the incident surface of the wire 150 and the nozzle outlet 136. The vapour blast device 100 can also be moved laterally along the direction x to treat other sections of the wire 150 and/or the wire may be passed in front of the stream 140. In some embodiments, the blast stream 140 may have substantially parallel sides to avoid a dispersion of power due to a diverging stream. The blast stream 140 may typically have a circular cross-section.

Figure 2:
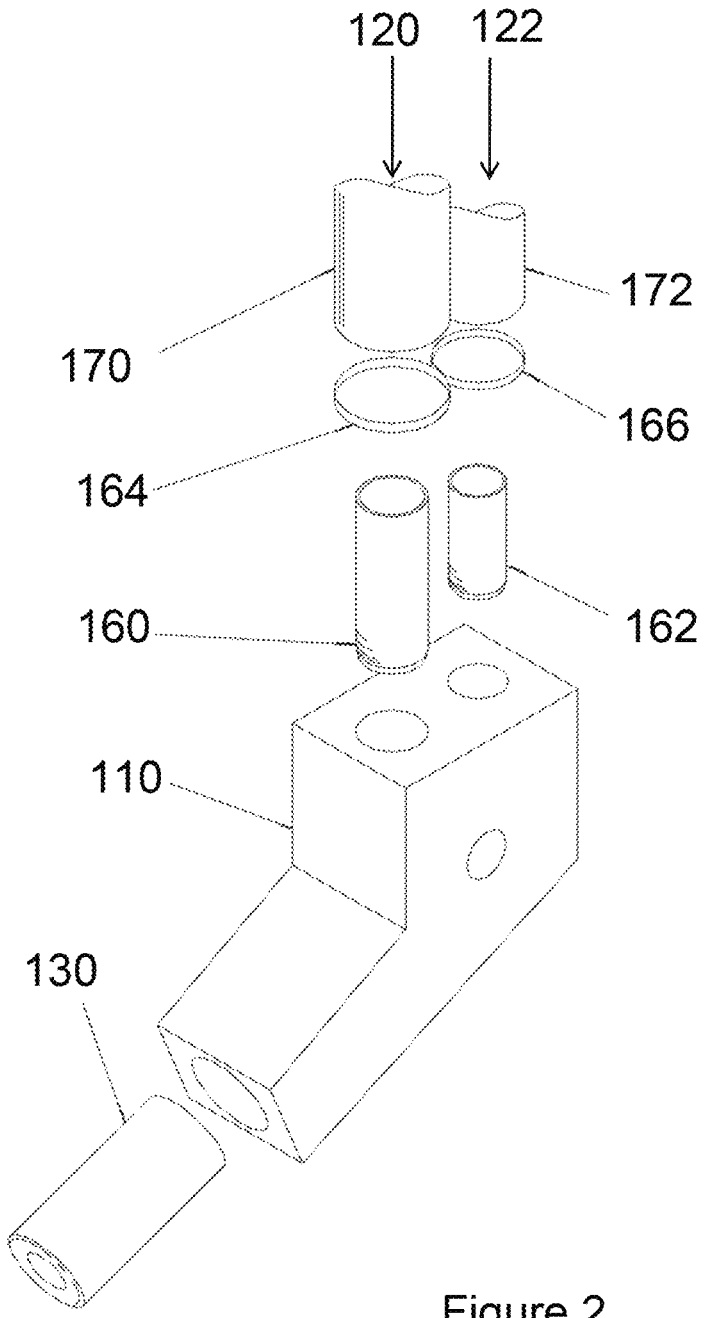
FIG. 2 illustrates an exploded view of part of the vapour blast device of FIG. 1.

FIG. 2 shows an exploded view of the device 100 of FIG. 1. In addition to the elements described in FIG. 1, the components for supplying the treatment material 120 and the pressurised gas 122 are shown. Each is supplied by connectors 160, 162 that couple hoses 170, 172 to the body 110 with hose clips 164, 166 or other means.

Figure 3:
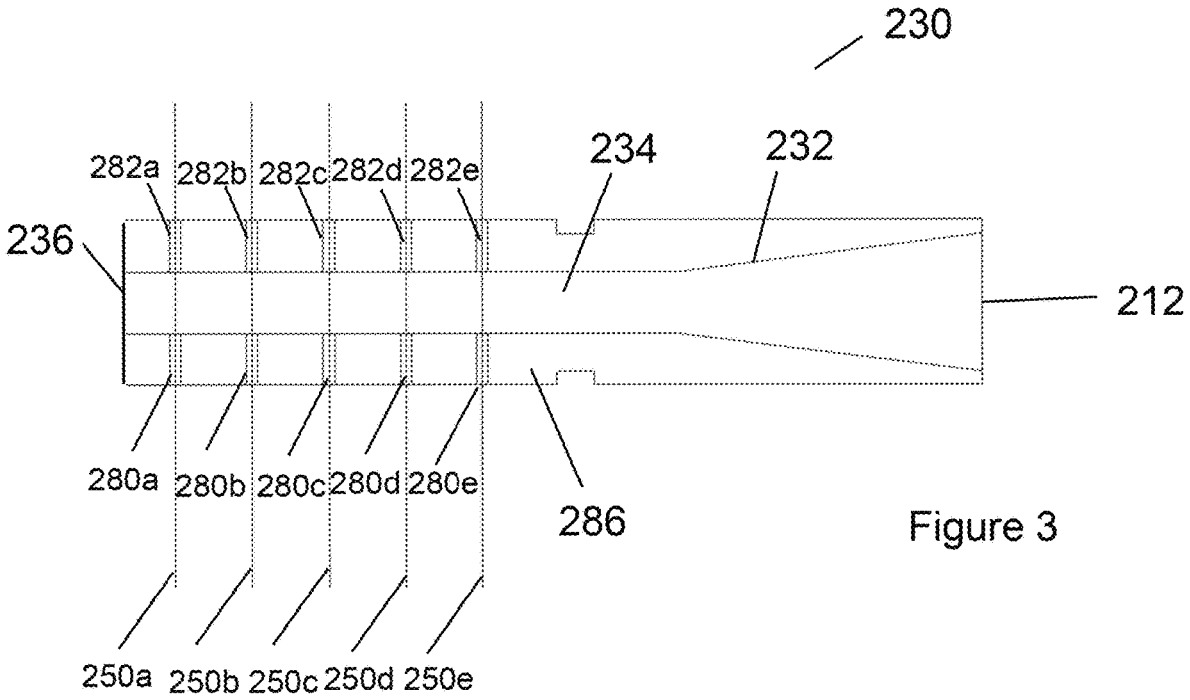
FIG. 3 illustrates a nozzle.

FIG. 3 shows a cross-sectional view of a nozzle according to the present disclosure. Such nozzle 230 is configured to receive an incident pressurised slurry or treatment material 212 supplied by means such as described above. The nozzle 230 comprises a frustoconical inlet 232 that tapers from the exterior of the nozzle 230 towards a bore 234 provided through the nozzle.

The bore 234 extends generally centrally and parallel to the major axis of the nozzle 230 from the inlet 232 to an outlet 236. The walls 286 of the bore 234 (i.e. the walls of the nozzle) contain a plurality of holes 280*a-e*, 282*a-e* that act to guide wires 250*a-e* through and perpendicular to the bore 234 to expose the wires 250*a-e* to the pressurised treatment material 212. In the example shown, entry holes 280 and exit holes 282 are provided. The entry and exit holes are aligned. It may be appreciated that the holes may not align or may align in a different manner, such as across a chord of the nozzle 230. Five wires 250 are shown in FIG. 3, although it can be appreciated that any number of wires may be treated by the single incident pressurised treatment material 212 at once, subject to space within the nozzle 230 and the diminishing blast effect along the nozzle as the blast stream 140 decelerates.

Also provided on the external wall 286 of the nozzle 230 are features to couple the nozzle 230 to a vapour blast device 100 such as shown in FIG. 1.

Figure 4:
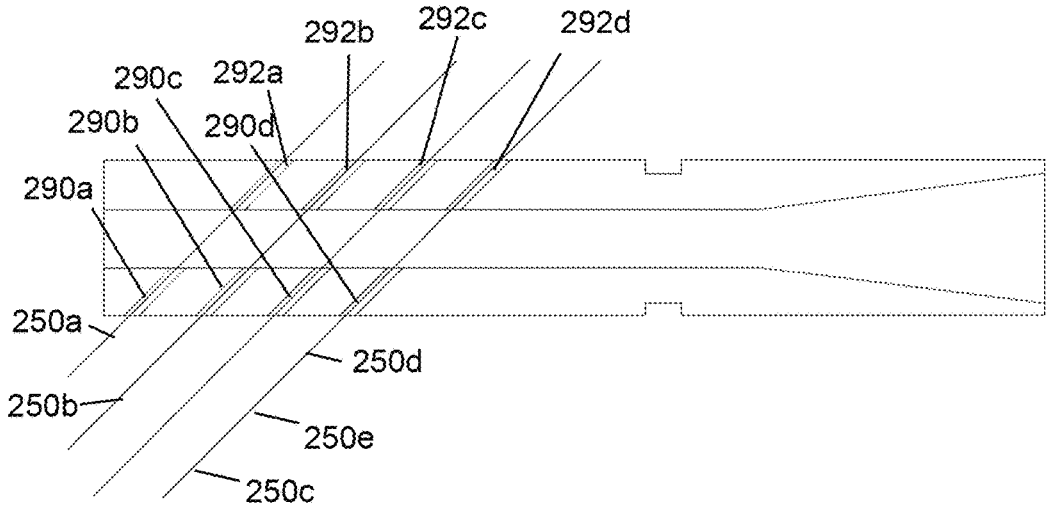
FIG. 4 illustrates an alternative embodiment of a nozzle.

FIG. 4 shows an alternative embodiment of the nozzle of FIG. 3. In this embodiment, the holes 290*a-d*, 292 *a-d* are provided at an angle of approximately 45 degrees relative to the perpendicular axis of the bore 234 of the nozzle 230. Entry 290 and exit 292 holes are again aligned to allow wires 250 to pass through the bore to be exposed to the stream of pressurised treatment material 212 flowing through the nozzle 230.

Figure 5:
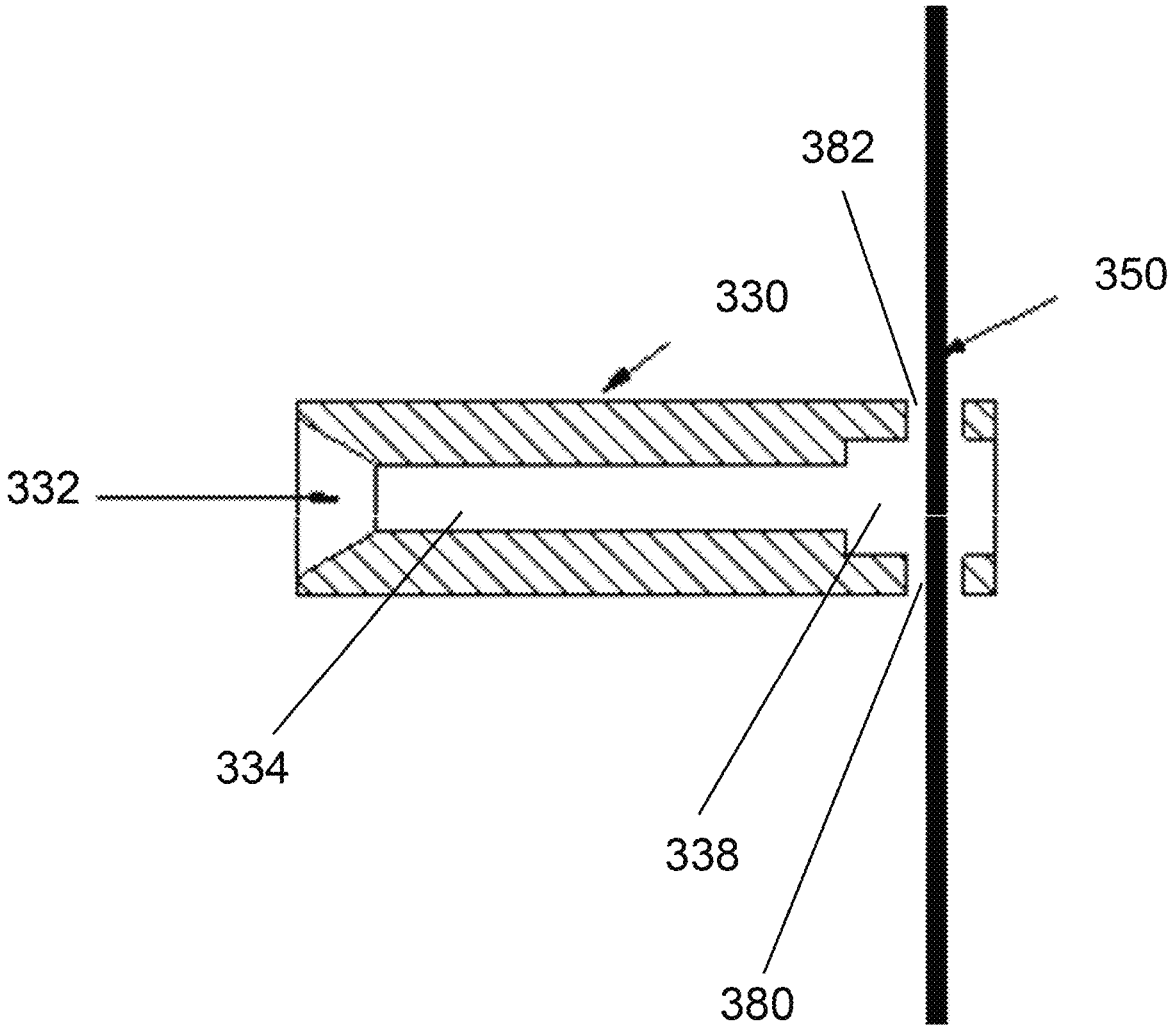
FIG. 5 illustrates an alternative embodiment of a nozzle.

FIG. 5 shows an alternative nozzle. A nozzle 330 is provided that is attachable to a blast gun (see below for details) using an attachment member and/or a shaped protrusion or the like (not shown). The nozzle generally comprises an elongate, typically tubular piece of metal or other material with a high wear resistance.

Nozzle 330 comprises an inlet 332, similar to inlet 232, for receiving a pressurised treatment material. Nozzle 330 further comprises a bore 334 in communication with the inlet 332, similar to bore 234. In contrast to bore 234, however, bore 334 comprises an enlarged section 338. The diameter of the bore in the enlarged section 338 is greater than the diameter of the bore in the non-enlarged section. Holes 380, 382, similar to holes 280, 282, pass through the walls of the nozzle 330 in the vicinity of the enlarged section 338. A product 350 passing through the holes 380, 382 therefore passes through the bore 334 in the enlarged section 338.

Holes 380, 382 may be aligned along a perpendicular axis of the bore 334, as for nozzle 230 in FIG. 3, or provided at an angle relative to the perpendicular axis of the bore 334. In particular, the holes 380, 382 may be provided at an angle of approximately 45 degrees (e.g. between 40 degrees and 50 degrees) relative to the perpendicular axis of the bore 334, similar to nozzle 230 shown in FIG. 4.

A pressurised treatment material may be injected into the inlet 332, and be forced along the bore 334 towards a product 350 that is being fed through holes 380, 382. The enlarged section allows the treatment material to pass around the product 350, so that the product 350 may be more effectively and efficiently treated.

Nozzle 330 may comprise a series of enlarged sections 338, and a plurality of pairs of holes 380, 382. Each pair of holes 380. 382 may enter the bore 338 in the vicinity of an enlarged section 338. Nozzle 330 may thus be used to treat a plurality of products 350 at once, similar to nozzle 230 above.

In particular examples, the diameter of the bore 334 in the non-enlarged section may be relatively thin, for example 2-5 mm in diameter. In such cases, the blast gun 100 may not be suitable for injecting treatment material into the nozzle, as it may cause a blockage in the bore 334.

Figure 6:
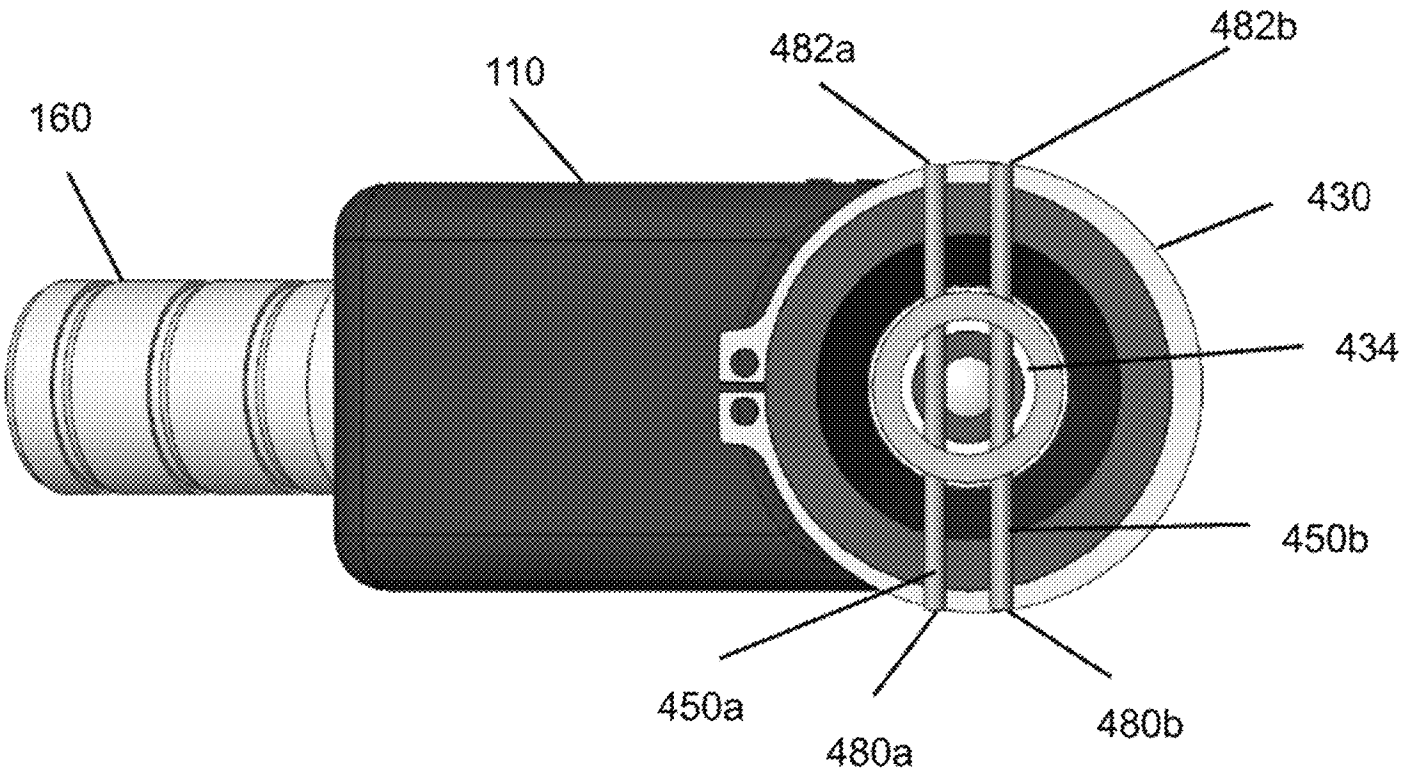
FIG. 6 illustrates an alternative embodiment of a nozzle.

FIG. 6 shows an alternative embodiment of a nozzle. Similar to the embodiment of FIG. 3, the walls of the bore of the embodiment of FIG. 6 comprise a plurality of holes 480*a,b* and 482*a,b*, which are perpendicular to the bore 434. In the illustrated view of FIG. 6, only holes 480*a,b* and 482*a,b* are visible, but the nozzle may comprise further holes (as shown, for example, in the nozzle of FIG. 7). In contrast to the embodiment of FIG. 3, each pair of holes 480*a,b* and 482*a,b* is aligned along an axis that does not intersect with the central axis of the bore 434. For example, if the bore has a substantially circular cross-section, each pair of holes 480*a,b*, 482*a,b* may be aligned along a chord of the circular cross section that is not the diameter of the circular cross-section. Although only holes 480*a,b* (and 482*a,b*) are shown, it can be appreciated that the number of holes 480, 482 can be tailored to the intended use and may vary according to the length of nozzle 430 used and the thickness of the wire 450 (or product) processed.

Figure 7:
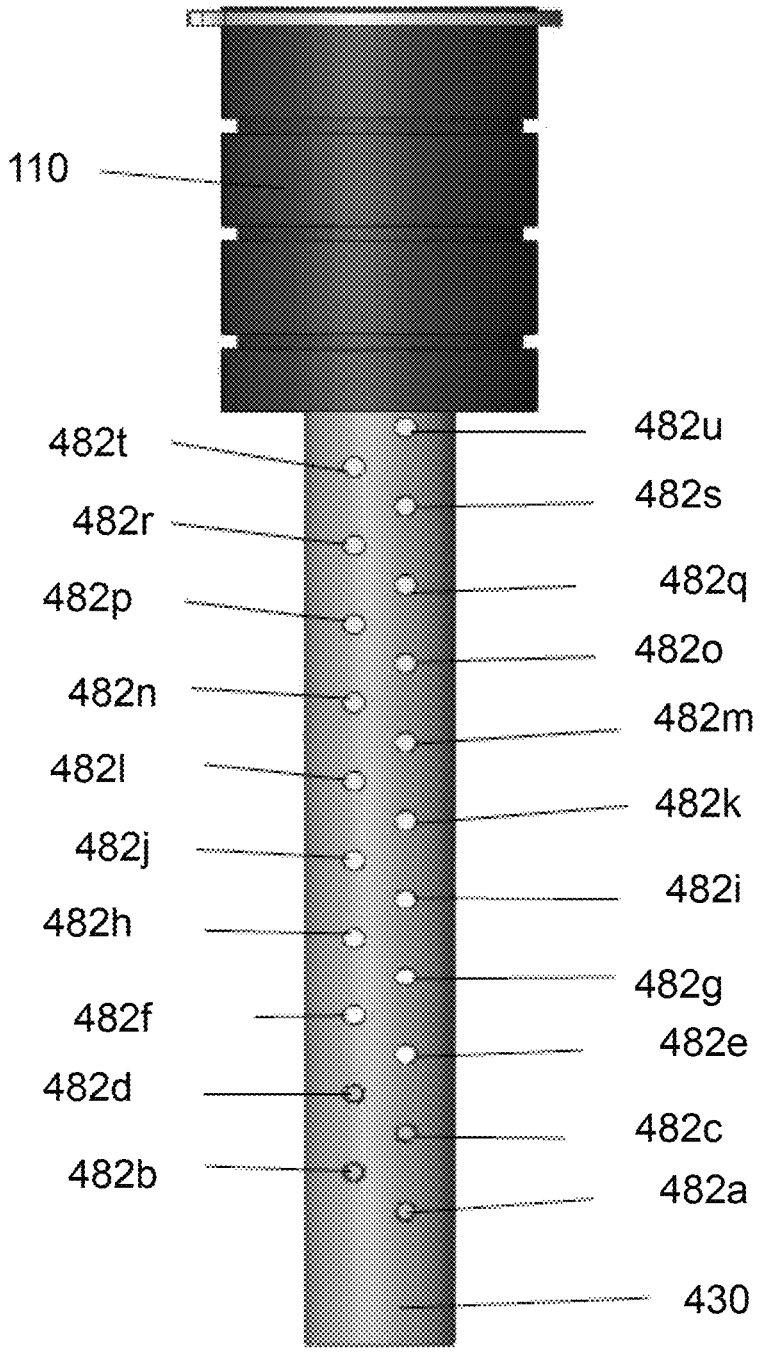
FIG. 7 illustrates an alternative view of the nozzle of FIG. 6.

FIG. 7 shows an alternative view of the nozzle of FIG. 6. In this embodiment, the walls of the bore comprise a plurality of holes 480*a-u*, 482*a-u*. Each pair of holes 480*a-u*, 482*a-u* is displaced from neighbouring pairs of holes 480*a-u*, 482*a-u*, so that the pairs of holes 480*a-u*, 482*a-u* are arranged in two rows along the length of the nozzle. In the illustrated view, only holes 482*a-u* are visible. Holes 480*a-u* are on the other side of nozzle 430. Accordingly, each pair of holes 480*a*, 482*a*, 480*b*, 482*b* 480*u*, 482*u* perpendicularly bisect the bore of the nozzle 430 to expose a portion of the wire or product 350 to the blast stream. It may be considered that each portion of the wire bisects the nozzle along a chordal length.

In other embodiments, the holes may be arranged to form a different number of rows along the length of the nozzle. For example, some of the pairs of holes 480*a-u*, 482*a-u* may be aligned along an axis that does intersect the central axis of the bore 434, so that the holes form three rows along the length of the nozzle.

Figure 8:
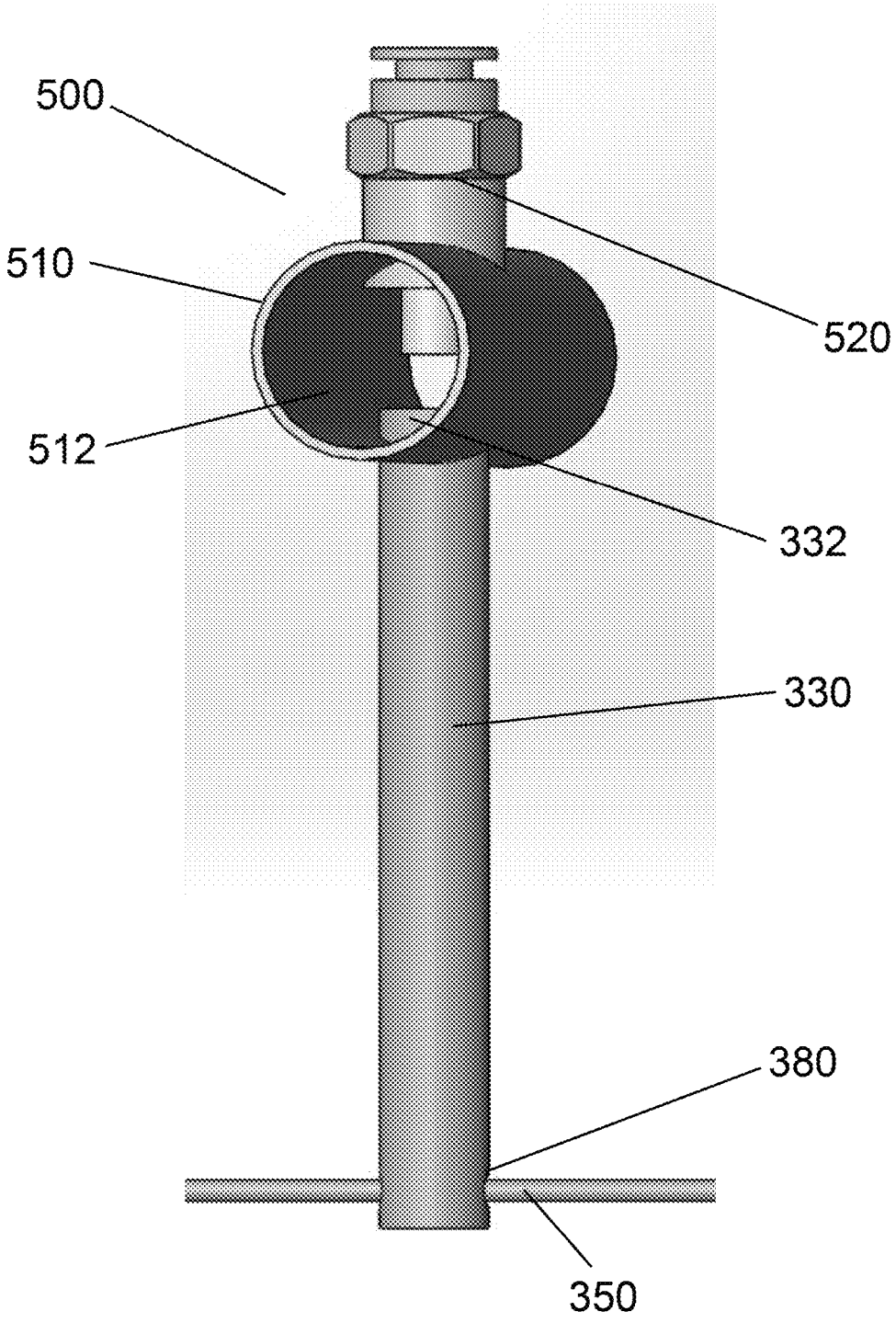
FIG. 8 illustrates an example blast gun utilising a nozzle as shown in FIG. 5.

An alternative example of a blast gun 500 that may be used with nozzle 330 is shown in FIG. 8. Blast gun 500 may, for example, be termed a micro wire blast gun.

Blast gun 500 comprises a treatment pipe 510 and a pressurised air inlet 520. A nozzle 330 is attached to the treatment pipe 510. The nozzle 330 may be a nozzle as described in relation to any previous figure. Treatment pipe 510 comprises a treatment bore 512 passing through the treatment pipe 510. The diameter of treatment bore 510 is larger than the non-enlarged section of the bore of the nozzle 330. The flow of treatment material through the treatment pipe is continuous, to prevent blockages. The treatment pipe is open ended to maintain the continuous flow, or may be partially open ended controlled by a valve or control orifice.

The nozzle 330 is attached to the pipe 510 such that the inlet 332 of the nozzle is in fluid communication with the bore 512 of the pipe 510. Nozzle 330 therefore extends from the pipe 510. In the illustrated example the nozzle 330 extends substantially perpendicularly from the pipe 510, but in other examples the nozzle may extend at other angles from the pipe 510.

The nozzle 330 may be attached to the pipe 510 for example by a nozzle attachment means (not shown). The nozzle attachment means may for example be a hole extending through the pipe 510 into the bore 512. The nozzle 330 can then be inserted into this hole to place the inlet 332 of the nozzle 330 in fluid communication with the bore 512 of the treatment pipe 410.

The pressurised air inlet 520 also extends from the pipe 510. Air inlet 520 comprises an air bore (not shown) that is in fluid communication with the treatment bore 512 of the pipe 510, and with the inlet 332 (and bore 334) of the nozzle 330. The air inlet 520 is generally aligned with the nozzle 330, so that pressurised air can be injected across the bore 510 and into the nozzle 310.

In use, a treatment material, such as a slurry of treatment material (typically an abrasive) and gas, flows through the bore 512 of the treatment pipe 510, for example under a low pressure. When treatment material is required in the nozzle 330 to treat a product 350, pressurised air is injected through air inlet 520. The pressurised air acts to force some treatment material from the bore 510 into the nozzle 330.

It can be appreciated that this allows the pressure or flow velocity of treatment material within the nozzle 330 to be highly controlled dependent upon the timing, duration and force of the pressurised air injected by the air inlet 520.

In this way, only a small amount of treatment material is injected into the nozzle 330 by the pressurised air from air inlet 520. This aids to avoid blockages in the nozzle 330, particularly where the nozzle comprises a bore having a small diameter.

By regulating the flow of compressed air, the flow of treatment material within the nozzle 330 is similarly regulated. This allows the pressure and flow velocity of the treatment material to be very high, to prevent blockages and to be tailored to the blasting requirements of the application (i.e. different blasting conditions dependent upon the product material, diameter, etc.). Additionally, the flow velocity of treatment material within the treatment pipe can be kept to a lower rate than typically required for blasting, reducing frictional losses within the system.

Figure 9:
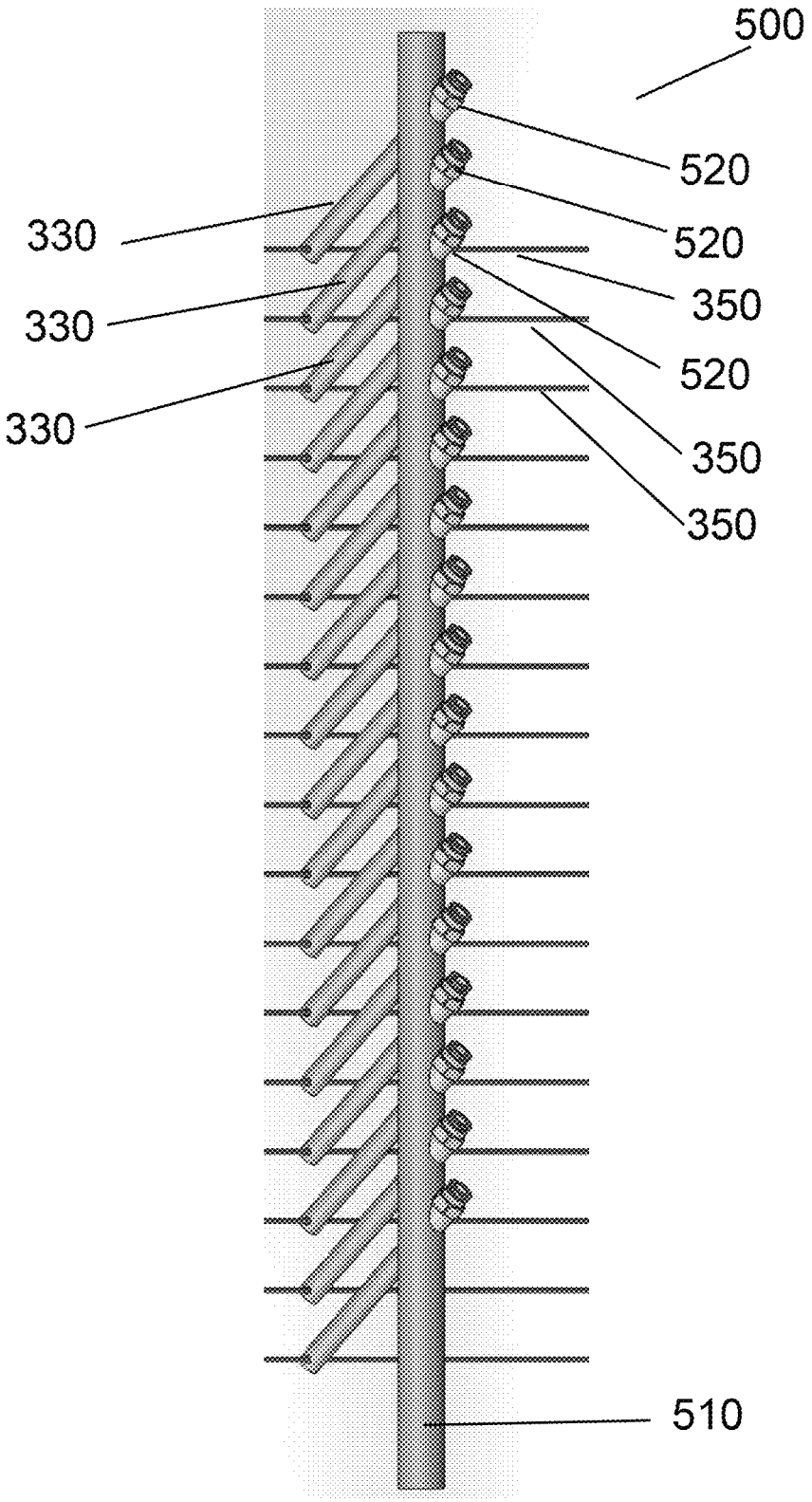
FIG. 9 illustrates an alternative example of the blast gun of FIG. 8.

A plurality of nozzles 330 may be attached to blast gun 500, in order to treat a plurality of products 350 at the same time. FIG. 9 shows an example of blast gun 500 attached to a plurality of nozzles 330.

Each nozzle 330 is attached to the pipe 510 as described above. In the example shown, the nozzles are aligned at an angle of approximately 40 degrees along and relative to the direction of flow of the treatment material within the treatment bore of the treatment pipe 510. The blast gun 500 comprises a separate pressurised air inlet 520 for each nozzle 330. Each air inlet 520 is attached to the pipe 510 as described above, so that the bore of each air inlet 520 is in communication with both the bore 512 of pipe 510, and inlet 322 of its respective nozzle 330. Each air inlet 520 may be used as described above to inject pressurised air into its respective nozzle 520. The pressurised air will also inject some of the treatment material passing along pipe 510 into the nozzle 330 associated with that air inlet 520.

Furthermore, it can be appreciated that each nozzle may be independently controlled to provide a different set of blasting parameters. It may be also envisaged that a product may pass between and through several nozzles, each providing a different blasting function or parameter. Such a system as shown in FIG. 9 provides a more efficient and controllable process for multiple blasting or blasting of multiple products.

Any nozzle described above may alternatively be used with blast gun 500 in place of nozzle 330.

Figure 10:
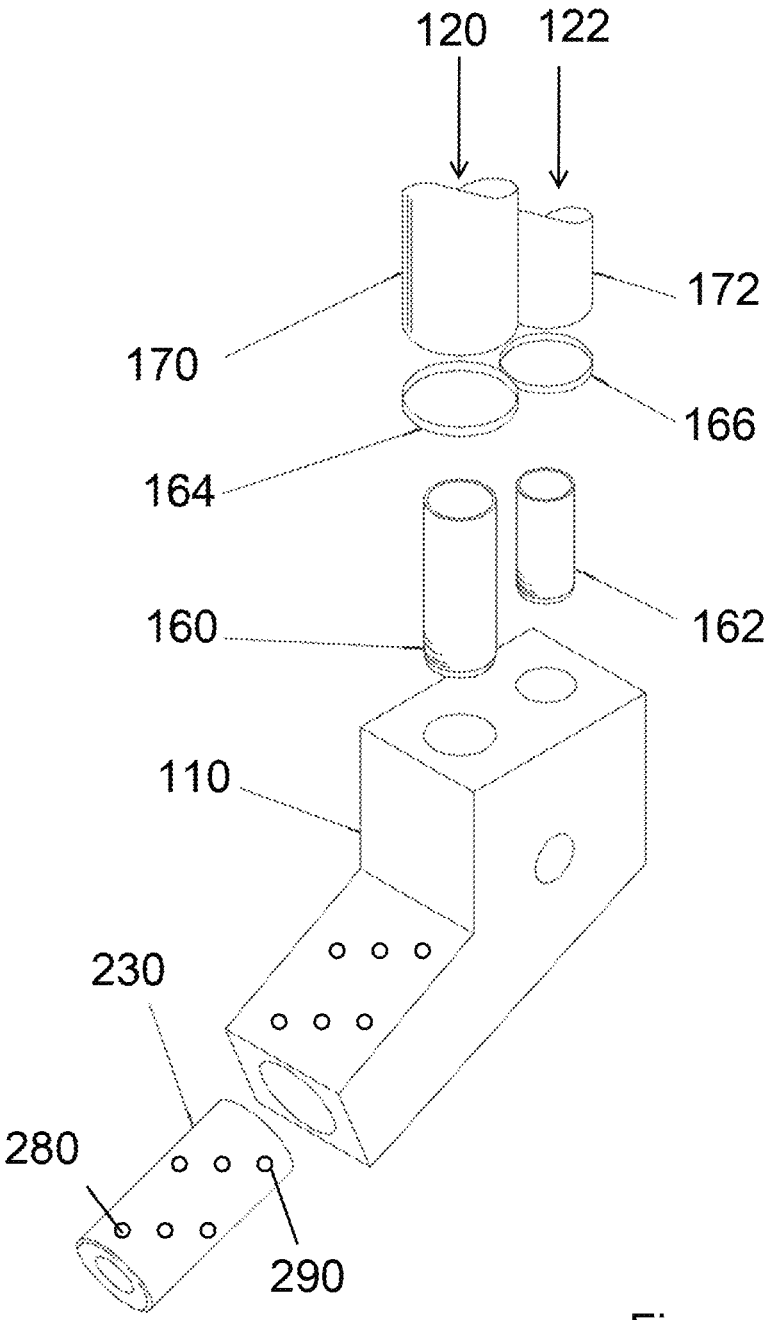
FIG. 10 illustrates a vapour blast device utilising a nozzle as shown in FIG. 3 or FIG. 4.

FIG. 10 shows the nozzle 230 used with the vapour blast device 100 described in FIGS. 1 and 2. The entry holes 280, 290 of the type described above with respect to FIGS. 3 and 4 may be provided within a single nozzle to provide alternative treatment angles for wires 250 passing through the bore of the nozzle 230.

Figure 11:
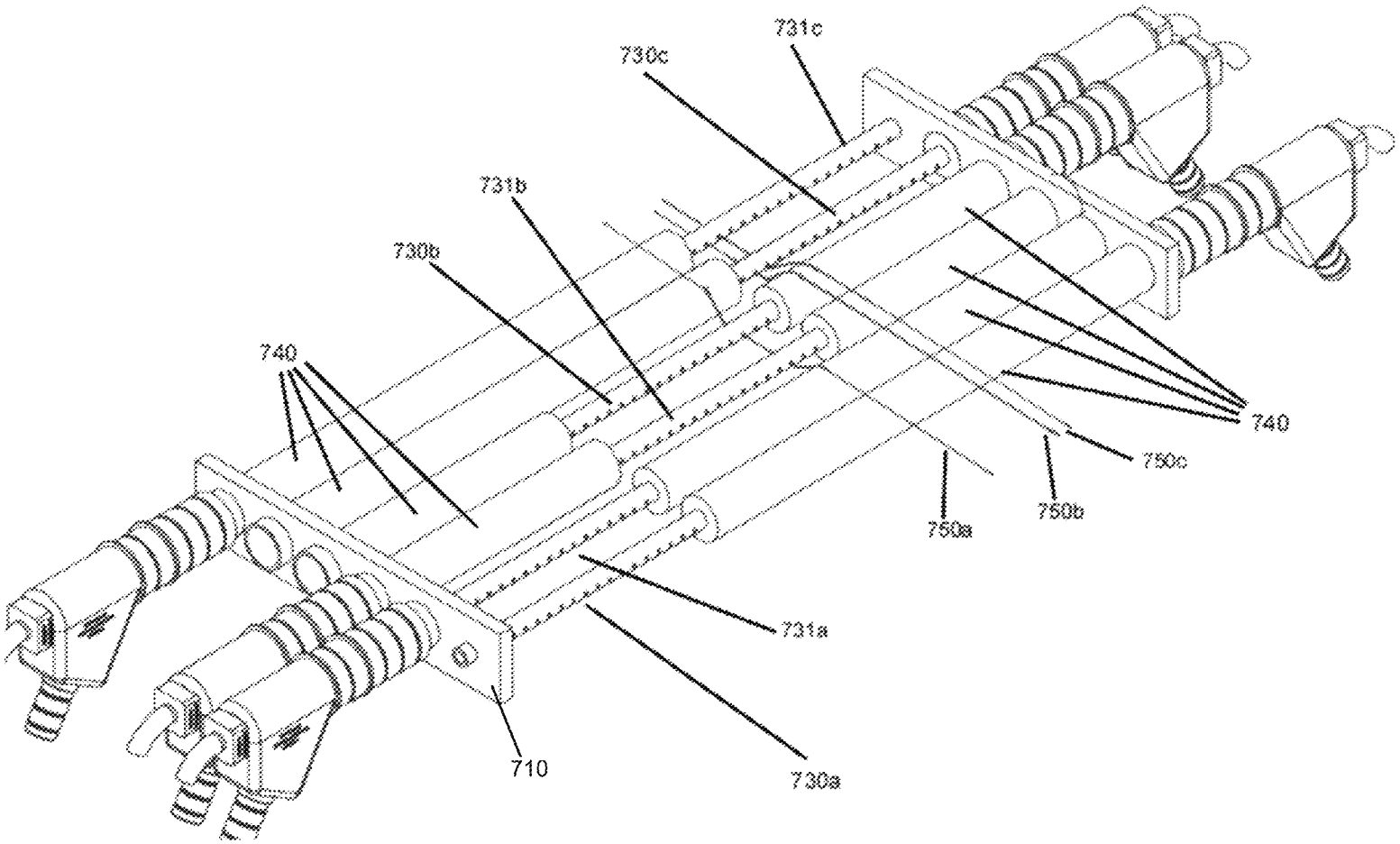
FIG. 11 illustrates an alternative vapour blast device.

FIG. 11 shows an alternative vapour blast device 700 comprising a plurality of nozzles 730*a-c*, 731*a-c*. Such a configuration may be useful if, for example, a large number of wires or products require treatment using the described wet blast (or vapour blast) treatment method. It has been discovered that scaling of the nozzle to include a large number of holes 780 in a single blast stream has limits. Once greater than 20 wires require processing, the efficiency of the vapour blast treatment diminishes. To overcome this limitation, the configuration of FIG. 8 has been designed to expose as much of the wire as possible to the high velocity blast stream.

Each nozzle 730*a-c*, 731*a-c* may, for example, be a separate vapour blast device 100. Each nozzle 730*a-c*, 731*a-c* comprises holes 780, 782, similar to holes 280, 282 described above. Only holes 780 are visible on the nozzles 730*a-c*, 731*a-c* shown in FIG. 10. For clarity, holes 780 are not labelled in the figure.

Each nozzle 730*a-c* is part of a pair of nozzles with a nozzle 731*a-c*. For each pair of nozzles 730*a-c*, 731*a-c*, the holes 780, 782 of the first nozzle 730*a-c* are aligned with the holes 780, 782 of the second nozzle 731*a-c*, so that a single wire may pass through the first nozzle 730*a-c* and the second nozzle 731*a-c* of a nozzle pair.

In the extended multiwire nozzle shown in FIG. 10, up to 50 wires 750*a-c* (only 3 shown for brevity) can be processed. The wires 750*a-c* are presented in a horizontal line separated by approximately 10 mm. The layout shown utilises 3 nozzles, each with a "high velocity section" for 17 wires. The remaining 33 wires can be deviated slightly to pass under/over the low velocity section 740 (where the bore diameter of the nozzles 730, 731 is higher) of adjacent nozzles.

In the illustrated embodiment, a wire 750*a* is shown passing through nozzles 730*b* and 731*b*, whilst wires 750*b* and 750*c* pass through nozzles 730*c* and 731*c*. Such an arrangement may allow extra cleaning of a wire. The holes 780, 782 may be aligned as described above in any embodiment of a nozzle 230.

As shown in the illustrated embodiment, each nozzle 730*a-c*, 731*a-c* comprises a low velocity section 740 that encloses the nozzle along part of the length of the nozzle. Each low velocity section 740 may facilitate movement of a wire through a different pair of nozzles 730*a-c*, 731*a-c* to the one which the section 740 is part of. For example, in the illustrated embodiment, wires 750*b* and 750*c* pass over nozzles 730*a*, 731*a*, 730*b*, and 731*b* and are deviated by the wider bore of the low velocity section 740 of the nozzles 730*a*, 731*a*, 730*b*, 731*b* before being directed to pass through nozzles 730*c* and 731*c*. In a preferred embodiment, holes 780, 782 are only located in the high velocity segments of the nozzle 730, 731. Alternatively, rollers or sleeves could be used to deviate the wires 750.

The plurality of nozzles 730*a-c*, 731*a-c* may be held together in a frame, such as frame 710. The plurality of nozzles may comprise any number of nozzles.

From reading the present disclosure, other variations and modifications will be apparent to the skilled person. Such variations and modifications may involve equivalent and other features which are already known in the art of vapour blasting, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality and reference signs in the claims shall not be construed as limiting the scope of the claims.

The invention claimed is:

1. A wet blast machine for cleaning or preparing surfaces of at least one product, said machine comprising:

a treatment source for providing a treatment material, comprising a treatment pipe for providing the treatment material to a plurality of nozzles, the treatment pipe comprising a treatment bore, wherein each nozzle extends from the treatment pipe such that a nozzle inlet of each nozzle is in fluid communication with the treatment bore;

a pressurized air source for pressurizing the treatment material;

a plurality of pressurized air inlet pipes extending from the treatment pipe, each air inlet pipe comprising an air bore in fluid communication with the treatment bore and a respective one of the plurality of nozzles, for diverting a portion of the pressurized mixture of treatment material into the nozzle through the inlet of the nozzle, wherein each nozzle comprises:

a central longitudinal axis;

a plurality of internal diameters along the central longitudinal axis such that the nozzle has a non-uniform internal diameter along its longitudinal axis;

the nozzle inlet for receiving the pressurised mixture of treatment material;

an outlet for ejecting said pressurised mixture; and at least one hole in a wall of the nozzle, said at least one hole for feeding the one or more products into one of the plurality of nozzles at an angle relative to the central longitudinal axis of the nozzle such that the surfaces of the at least one product are exposed to the treatment material whilst within the respective nozzle, and wherein the at least one hole is in a portion of the nozzle such that the one or more products are exposed to the treatment material at a maximum flow velocity of the treatment material.

2. The machine of claim 1, wherein the longitudinal central axis of the nozzle is substantially perpendicular to a longitudinal central axis of the treatment bore.

3. The machine of claim 1, wherein a respective longitudinal central axis of each of the air bores is substantially perpendicular to a longitudinal central axis of the treatment bore and wherein each longitudinal central axis of each respective air bore is axially aligned with the respective longitudinal central axis of each of the plurality of nozzles.

4. The machine of claim 1, wherein an internal. diameter of the treatment bore is larger than an internal diameter of the plurality of nozzles.

5. The machine of claim 1, wherein a flow velocity of treatment material through at least one of the nozzles is greater than the flow velocity of treatment material through the treatment pipe.

6. The machine of claim 1, wherein at least one hole guides at least one product transverse to a longitudinal central axis of the nozzle.

7. The machine of claim 1, wherein the at least one hole comprises a pair of holes, said pair being provided substantially perpendicular to the longitudinal central axis of the nozzle aligned along an axis that intersects the longitudinal central axis of the nozzle.

8. The machine of claim 1, wherein the at least one hole comprises a pair of holes, said pair being provided at an angle relative to the longitudinal central axis, that is preferably between 60 and 120 degrees.

* * * * *